US005083763A

United States Patent [19]

Hartta

[11] Patent Number: 5,083,763

[45] Date of Patent: Jan. 28, 1992

[54] METHOD AND APPARATUS FOR THE PICKING UP AND HANDLING OF SHEETS OF MATERIAL, IN PARTICULAR SHEETS OF POROUS AND FLEXIBLE MATERIAL

[75] Inventor: Matti Hartta, Söömarkku, Finland

[73] Assignee: Cimcorp Oy, Ulvila, Finland

[21] Appl. No.: 674,362

[22] PCT Filed: Oct. 10, 1989

[86] PCT No.: PCT/FI89/00193

§ 371 Date: Apr. 16, 1991

§ 102(e) Date: Apr. 16, 1991

[87] PCT Pub. No.: WO90/04558

PCT Pub. Date: May 3, 1990

[30] Foreign Application Priority Data

Oct. 27, 1988 [FI] Finland ..... 884948

[51] Int. Cl.[5] ..... B65H 3/30

[52] U.S. Cl. ..... 271/20; 271/92; 271/98; 271/103; 271/106

[58] Field of Search ..... 271/20, 91, 92, 93, 271/98, 103, 104, 105, 106

[56] References Cited

U.S. PATENT DOCUMENTS

| | | | |
|---|---|---|---|
| 2,225,006 | 12/1940 | Gudger et al. | 271/93 |
| 3,322,301 | 5/1967 | Bliss | 271/20 X |
| 3,809,388 | 5/1974 | Downing . | |
| 3,826,485 | 7/1974 | Shindo . | |
| 4,311,304 | 1/1982 | Hamada et al. | 271/91 X |
| 4,601,463 | 7/1986 | Goto et al. . | |

FOREIGN PATENT DOCUMENTS

| | | | |
|---|---|---|---|
| 165019 | 12/1985 | European Pat. Off. . | |
| 1110126 | 10/1955 | France | 271/20 |
| 628696 | 11/1961 | Italy | 271/20 |
| 0057146 | 4/1982 | Japan | 271/20 |
| 0087141 | 5/1985 | Japan | 271/91 |
| 1402394 | 6/1988 | U.S.S.R. | 271/91 |
| 2028281 | 3/1980 | United Kingdom | 271/91 |

*Primary Examiner*—H. Grant Skaggs
*Assistant Examiner*—Carol Lynn Druzbick
*Attorney, Agent, or Firm*—Dellett, Smith-Hill and Bedell

[57] ABSTRACT

The invention relates to a method for picking up sheets of paper, cardboard or similar, especially porous material, one at a time from a pile of sheets for onward transfer, using a gripping apparatus fitted with gripping means and a sheet support disk, and a gripping apparatus for effecting the method. According to the invention when the gripping apparatus is brought to the pile of sheets it achieves the following steps:

a. the pile of sheets is pressed on its top in the central region thereof,
b. the gripping means is moved and presses the top of the pile on both sides of said central region,
c. the top sheet on the pile is distorted preferably from both sides of the central region of the pile by making use of movement of the gripping means towards the central region of the pile so that said top sheet bends partly clear from the sheet under it,
d. the top sheet of the pile is raised up by the gripping means to the level of the support disk at the same time as pressure is still being applied to the central region of the pile,
e. the pressure on the central region of the pile is ceased and simultaneously the sheet is flattened out against the support disk by moving the gripping means outwards from the central region of the sheet.

10 Claims, 3 Drawing Sheets

METHOD AND APPARATUS FOR THE PICKING UP AND HANDLING OF SHEETS OF MATERIAL, IN PARTICULAR SHEETS OF POROUS AND FLEXIBLE MATERIAL

The invention relates to a method of the kind referred to in the preamble to claim 1, and an apparatus of the kind referred to in the preamble to claim 7, for picking up sheets of paper, cardboard or similar, especially porous material, one at a time from a pile for onward transfer, using a gripping apparatus fitted with a gripping means.

When picking up sheets of porous material such as paper or cardboard, which are stored in piles, the problem is to pick up only a single sheet from the top of the pile, so that the next sheet does not stick to it or several sheets come with it. The problem is worse when the pile is higher because the sheets at the bottom of the pile usually "stick" together as a result of the weight on top of them. On the other hand the sheets can be rather large in diameter, for example 600 mm-1500 mm, of such a size that the rapid transport of flexible and porous paper type material from the pile to the place of use using a gripping device can be problematic owing to air resistance.

Earlier solutions are usually based on level suction cup devices without special movements for separating the sheets. Particularly when dealing with the gripping of porous materials, it is very easy that more than one sheet will come away together. Methods for separating these additional sheets have been developed, for example a means by which brushes are arranged at the edge of the pile to prevent the second sheet coming away with the top one. This solution is in practice unreliable and also limits the height of the pile which, according to known technique, can be only up to some 300 mm.

The patent publication U.S. Pat. No. 3,826,485 shows a solution according to which the pile of sheets is pressed on top of it at the central region thereof and the gripping means are moved on either side of the central region. In order to separate the topmost sheet from the pile at first only one of the gripping means is lifted. All the lifting movements of the gripping means take place right upwards from the pile and, thus, include no further movements to forward said separation so as to make sure that only one sheet is moved at a time. As a consequence this solution is in practice applicable only for relatively stiff sheet materials.

The solution shown in U.S. Pat. No. 3,809,388 on the other hand includes separate members for bending the topmost sheet from its central region upwards so as to separate it from the pile of sheets, for gripping it for transport and for pressing the next sheet in the pile on the edge parts thereof against the pile to prevent its movement. This solution is applicable in the first place only for sheets of relatively thin and flexible material. These both known solutions provide poor support for the sheet being transported, which may pose problems particularly when moving large sheets of thin material from the pile to the required place.

The aim of the invention is to achieve a new and improved method and apparatus, with the help of which the drawbacks of the known art may be eliminated. The aim of the invention is to develop a solution, by means of which differing sized sheets of porous and flexible material may be picked up one at a time from a pile, so that the next sheet is not moved in the pile, for quick and secure transport onward to the required place. A further aim is to be able to pick up and handle thin and flexible sheets like those made of paper as well as sheets of relatively stiff material like cardboard by making use of the same apparatus.

The aims of the invention are achieved in the way described in claims 1 and 7. Additional features of the invention become clear from the subclaims.

The invention is essentially based on the idea that by pressing on the centre of the pile and simultaneously by making use of the movement of a gripping means towards the central part of the pile the top sheet of the pile is caused to be partly bent away from the next sheet on the pile. Then raising the gripping means up, while still pressing on the centre of the pile, will ensure that the top sheet is separated from the one below. Use of a support disk forwards secure transport of sheets of various kinds and materials from the pile to the required place.

When dealing with stiffer material, such as a sheet of cardboard, the movement of the gripping means towards the central part can be combined with a simultaneous lifting upwards. In this case the griping means are not actually moved towards the central part but said movement is determined by bending of the sheet as a result of the lifting movement upwards. In this case the gripping means can, with advantage, be further arranged to be turnable so that, the edges of the topmost sheet to be picked up are bent by the gripping means towards the pile, which will further ensure separation of the topmost sheet.

By using the arrangement according to the invention the size of the pile can be considerably increased, for example 2000 mm or higher is feasible depending on the place of application, because the "sticking" of one sheet to another, particularly in the lower part of the pile, no longer constitutes a problem when picking them up, but the sheets will in all cases be efficiently separated from one another. In this way storage capacity can be markedly increased, for which reason the need to replenish the piles and general supervision of the picking up of the sheets will be appreciably reduced.

For the secure transport of particularly large and flexible sheets, it is an advantage to fit the support disk of the gripping apparatus in accordance with the invention with an air blast arrangement, which comprises a set of nozzles, which are arranged to blast air from the centre of the support disk to its edge, between the support disk and the sheet being gripped, so as to hold it against the support disk for transport.

In the following the invention is explained more clearly with reference to the attached drawings, in which.

Figure 1:
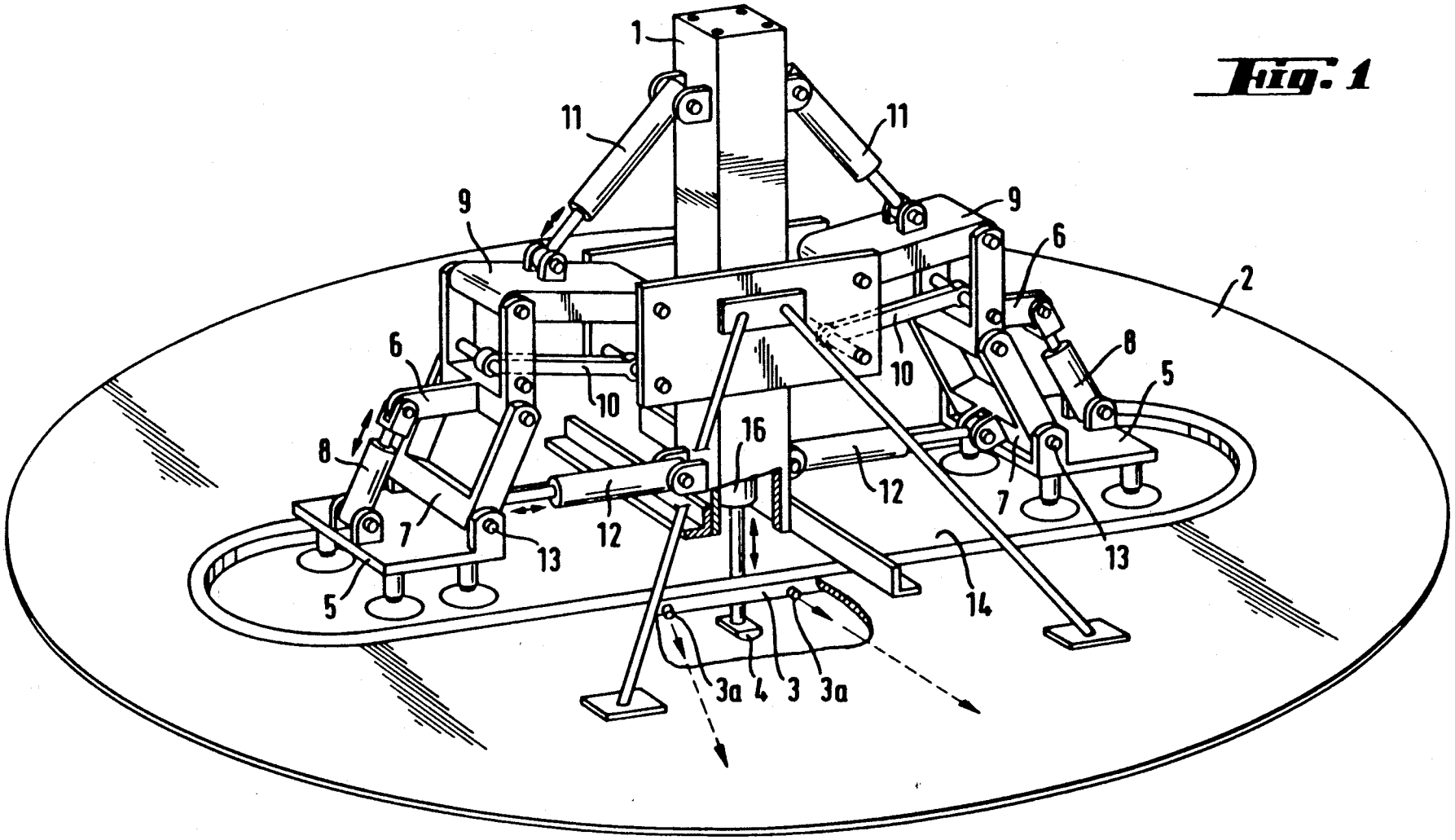
FIG. 1 shows a perspective view of a sheet material handling apparatus according to the invention.

In the Figures the number 1 refers to the frame of the gripping apparatus, to which is securely attached a support disk 2. The support disk 2 is provided with a through going opening 14, through which a pressure means 4 and two gripping means 5 on either side of the pressure means 4 can move. The pressure means 4 is moved by means of a power cylinder 16. Both gripping means 5 comprise a group of suction cups.

The gripping means 5 is attached to the frame 1 by means of two sets of levers in the form of parallelograms and a middle piece 6. A lever 7 and a cylinder 8 form the lower parallelogram and levers 9 and 10 form the upper parallelogram. The vertical movement of the gripping means 5 is achieved by means of the power cylinder 11. Lateral movement is achieved by means of cylinder 12 The movement of the gripping means 5 around axles 13 is achieved by means of cylinders 8.

Around the edge of the opening 14 in the support disk 2 is a pipe 3, fitted with nozzles 3*a*, which are arranged so that a blast of air can be directed outwards along the bottom of the support disk towards its edge.

The operation of method according to the invention is explained in the series of drawings 2A-2G, which refer to handling of sheets of paper or similar flexible material. In stage 1 (FIG. 2A) the pressure means 4 in the middle of the gripping apparatus is extended and presses against the centre of the pile of sheets 15 so that the sheets of the pile stay in place. In stage 2 (FIG. 2B) the gripping means 5 of the gripping apparatus are forced out by the cylinders 11 (FIG. 1) on both sides of the pressure means 4, and also press against the pile of paper. In practice this may happen almost simultaneously with stage 1. The group of suction cups grip the paper by means of suction or friction.

In stage 3 (FIG. 2C) the gripping means 5 are moved towards the central part of the apparatus by means of the cylinder 12 (FIG. 1), at which point the top sheet 15*a* of the pile springs up on both sides of the pressure means 4 and air passes between the top sheet 15*a* and the next sheet. At latest after the sideways movement of the gripping means 5 has stopped in stage 4 (FIG. 2D) suction is connected to the groups of suction cups of both gripping means 5. In stage 5 (FIG. 2E) the groups of suction cups of both gripping means 5 are raised upwards to the level of the support disk 2 by means of cylinders 11, at which point the sheet remains bent, hanging from the suction cups. In stage 6 (FIG. 2F) the pressure means 4 is raised up and simultaneously the gripping means 5 are moved back to their original position by means of the cylinders 12. In stage 7 (FIG. 2G) a strong blast of air is blown between the sheet and the support disk 2 from the centre outwards, by means of the pipe 3 and nozzles 3*a*, at which point the sheet 15*a* is sucked against the support disk 2 and is ready for transport For handling stiffer, cardboard type or similar material the method shown in FIGS. 4A-E is used, which is explained in the following. In stage 1 (FIG. 4A) the pressure means 4 in the centre of the gripping apparatus is extended and presses against the centre of the pile to keep the sheets of cardboard in place. In stage 2 (FIG. 4B) the groups of suction cups of the gripping means 5 on either side of the pressure means 4 are forced out by means of the cylinders 11 (FIG. 1) and they also press against the surface of the pile 15. Simultaneously suction is connected to the groups of suction cups of both gripping means 5. In stage 3 (FIG. 4C) both gripping means 5 are lifted up to the level of the support disk 2 by means of the cylinders 11 and simultaneously they move towards the pressure means 4 by the amount determined by the bending of the sheet of cardboard 15*a*. At this stage there is no pressure in the cylinders 12.

In stage 4 (FIG. 4D) both gripping means 5 are turned by means of cylinders 8 so that the edges of the cardboard sheet 15*a* are bent downwards towards the surface of the pile 15. In stage 5 (FIG. 4E) the pressure means 4 is raised to the level of the support disk 2 and the gripping means 5 are moved outwards with regard to the pressure means 4 by means of the cylinders 12. Simultaneously the gripping means 5 are turned to the direction of the support disk 2 by means of cylinders 8 so that the cardboard sheet is in line with the support disc 2. As will be noticed the movement of the stage 3 of the handling of stiffer sheets is a combination of the movements of the stage 3 and 5 (FIG. 2C and 2E) in the handling of thinner and more flexible sheets. Another difference is the turning of the gripping means 5 around the axles 13 in FIG. 1 in stage 4.

The invention can handle materials with different degrees of flexibility and porousness, such as paper and board, but also cloth, different kinds of plastic products etc. One advantageous embodiment of the invention is the handling of paper and cardboard end cover sheets that are used in the packing process for large paper rolls.

Figure 2A:
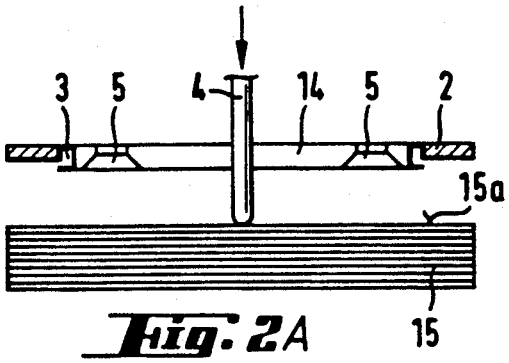
FIGS. 2A-2G illustrate measures to be taken in the method according to the invention when applied to picking up of thin porous sheets.
Figure 2B:
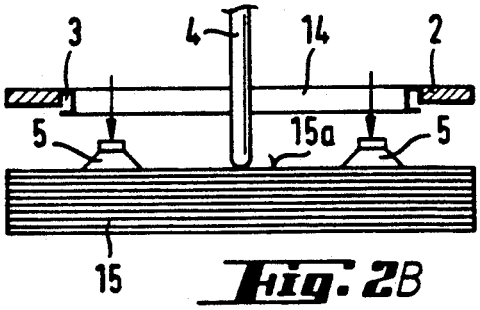
Figure 2C:
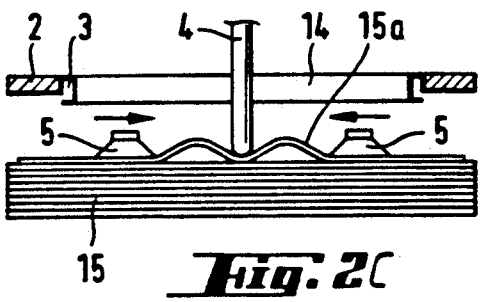
Figure 2D:
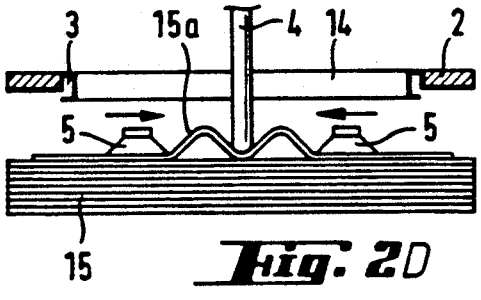
Figure 2E:
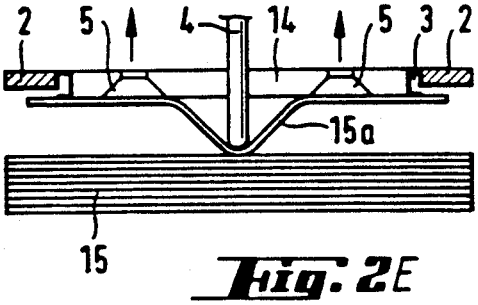
Figure 2F:
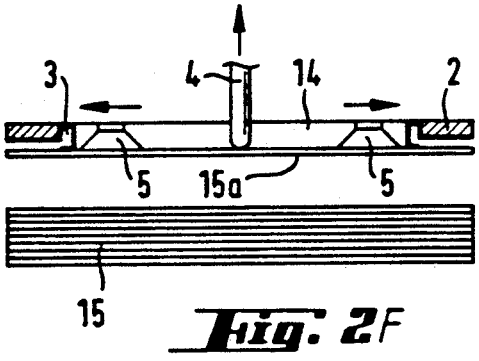
Figure 2G:
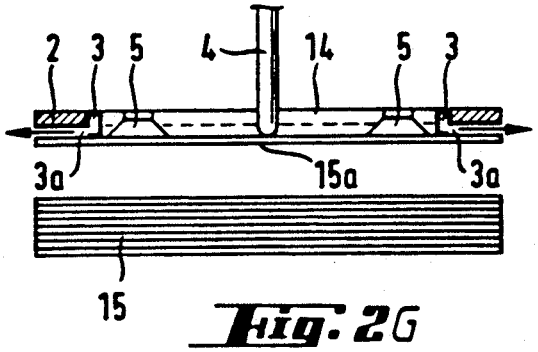
Figure 3:
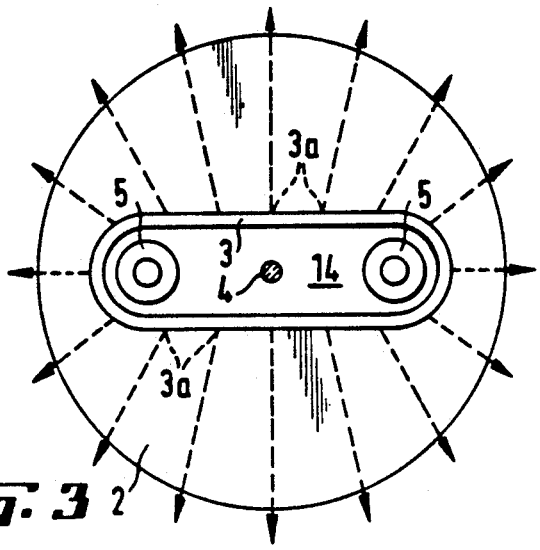
FIG. 3 shows the arrangement in FIG. 2G as seen from above.
Figure 4A:
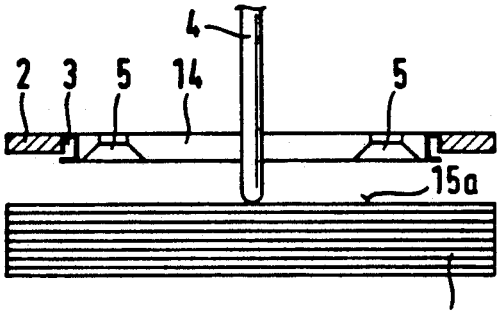
FIGS. 4A-4E illustrate measures to be taken in the method according the invention when applied to picking up of sheets of stiffer material.
Figure 4B:
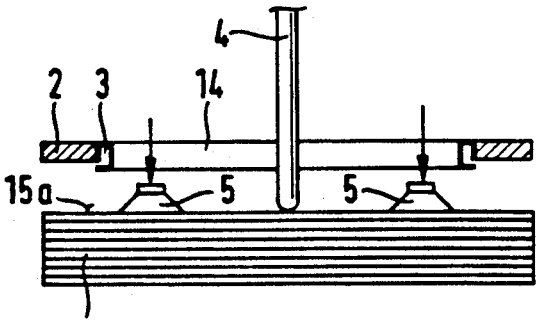
Figure 4C:
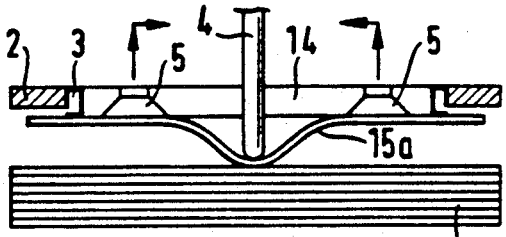
Figure 4D:
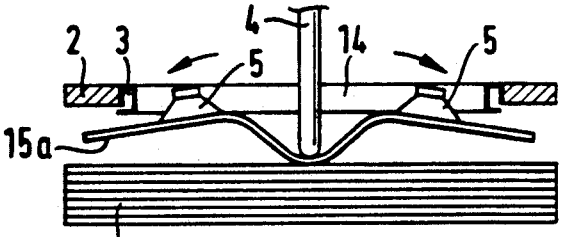
Figure 4E:
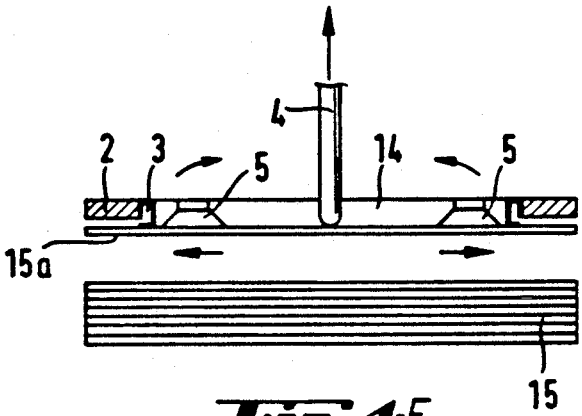

Depending on the application a gripping apparatus as shown in FIG. 1 can be attached to be part of a variety of transport means for moving the sheets from the pile to the place of use as required. The apparatus according to the invention can move sheets to the required place at high speed, because the sheet is held by suction tight against the support disk. The apparatus can also be programmed, so that the gripping means is capable of picking up alternately materials having different properties of flexibility without changing the settings.

The invention is not limited to the embodiments shown, but several modifications thereof are feasible within the scope of the attached claims.

I claim:

1. A method for picking up sheets of paper, cardboard or similar material, one at a time from a pile of sheets for onward transfer, using a gripping apparatus fitted with gripping means and a sheet support disk, characterized in that when the gripping apparatus is brought to the pile of sheets it achieves the following steps:

a. the pile of sheets is pressed on its top in the central region thereof, b. the gripping means is moved and presses the top of the pile on both sides of said central region, c. the top sheet on the pile is distorted from either side of the central region of the pile by making use of movement of the gripping means towards the central region of the pile so that said top sheet bends partly clear from the sheet under it, d. the top sheet of the pile is raised up by the gripping means to the level of the support disk at the same time as pressure is still being applied to the central region of the pile, e. the pressure on the central region of the pile is ceased and simultaneously the sheet is flattened out against the support disk by moving the gripping means outwards from the central region of the sheet.

2. A method according to claim 1 applied for handling relatively stiff, cardboard or similar material, characterized in that steps c. and d. are performed simultaneously.

3. A method according to claim 2, characterized in that before step e. is performed the edge of the top sheet is bent downwards towards the pile by turning the gripping means.

4. A method according to claim 3, characterized in that at the same time as step e. the gripping means are turned back into an even position so that the sheet being lifted is flattened out against the support disk.

5. A method according to claim 1, in which the said gripping means operates by suction, characterized in that the gripping means is connected to the suction at the stage when the sheet being picked up is lifted upwards from the pile, but the pile is still being pressed in its central region.

6. A method according to claim 1, characterized in that, when a sheet is of relatively flexible material, a strong blast of air is blown between the support disk and the sheet, being flattened out against it, from the central part towards the edges so that the sheet is sucked to and remains against the support disk ready for transport.

7. A gripping apparatus for picking up sheets of paper, cardboard or similar porous material one at a time from a pile of sheets (15) for onward transfer, which apparatus includes a support disk (2), gripping means (5) and pressure means (4), characterized in that there is an opening (14) in the central part of the support disk (2), through which said pressure means (4) and the gripping means (5) situated on both sides of the pressure means (4) are arranged to move on to the top of the pile of sheets (15), and that the apparatus is additionally fitted with means (12) for moving the gripping means (5) towards the pressure means (4) at the central region of the pile of sheets so that the topmost sheet (15*a*) is bent partly clear from the sheet under it on the pile at the same time as the pressure means (4) is pressing on the central region of the pile.

8. A gripping apparatus according to claim 7, characterized in that it is fitted with means (8) for turning the gripping means (5) around an axle (13) parallel with the plane of the support disk (2).

9. A gripping apparatus according to claim 7, characterized in that the support disk (2) is fitted with an air blast system (3), which comprises a number of nozzles (3*a*), which are arranged to blow air from said opening (14) in the support disk towards its edge, between the support disk (2) and the sheet (15*a*) being picked up so that the sheet is held against the support disk (2) for transport.

10. A gripping apparatus according to claim 7, characterized in that the gripping means (5) comprises a number of suction cups, which are arranged in two groups on either side of the pressure means (4).

* * * * *